US010252838B2

(12) United States Patent
Ban

(10) Patent No.: US 10,252,838 B2
(45) Date of Patent: Apr. 9, 2019

(54) DRINKING CONTAINERS AND RELATED METHODS

(71) Applicant: Takeya USA Corporation, Huntington Beach, CA (US)

(72) Inventor: Yukio Ban, Osaka (JP)

(73) Assignee: Takeya USA Corporation, Huntington Beach, CA (US)

( * ) Notice: Subject to any disclaimer, the term of this patent is extended or adjusted under 35 U.S.C. 154(b) by 0 days.

(21) Appl. No.: 15/446,215

(22) Filed: Mar. 1, 2017

(65) Prior Publication Data

US 2017/0253392 A1 Sep. 7, 2017

Related U.S. Application Data

(60) Provisional application No. 62/302,711, filed on Mar. 2, 2016.

(51) Int. Cl.

| | |
|---|---|
| ***B65D 43/22*** | (2006.01) |
| ***B65D 47/08*** | (2006.01) |
| ***A47G 19/22*** | (2006.01) |
| ***B65D 43/02*** | (2006.01) |
| ***B65D 43/16*** | (2006.01) |
| ***B65D 47/32*** | (2006.01) |
| ***B65D 51/18*** | (2006.01) |
| ***A47G 19/00*** | (2006.01) |

(52) U.S. Cl.

CPC ..... *B65D 43/22* (2013.01); *A47G 19/00* (2013.01); *A47G 19/2272* (2013.01);

(Continued)

(58) Field of Classification Search

CPC ..... B65D 43/22; B65D 43/16; B65D 43/02; B65D 43/163; B65D 47/0857;

(Continued)

(56) References Cited

U.S. PATENT DOCUMENTS 2,447,870 A * 8/1948 Polcyn ..... A47G 19/2272 215/309
2,764,199 A * 9/1956 Tupper ..... B65D 47/0885 16/265

(Continued)

FOREIGN PATENT DOCUMENTS

JP 2009-161196 A 7/2009
JP 2014-500835 A 1/2014

OTHER PUBLICATIONS

Extended European Search Report on related EP application (EP17158691.0) from European Patent Office (EPO) dated Apr. 21, 2017.

(Continued)

*Primary Examiner* — Robert J Hicks

(74) *Attorney, Agent, or Firm* — Klein, O'Neill & Singh, LLP

(57) ABSTRACT

A drinking bottle assembly includes a lid assembly with a lid housing having a top wall, a flap rotatably coupled to the top wall, and a gasket secured to the flap. A drink opening extends through the top wall. A rim extends above the top wall. At least one notch is located in an inner surface of the rim. The flap includes a flexible portion or extension and at least one locking lug projecting from the flexible portion. The locking lug engages the at least one notch in a closed position. The flap is rotatable from the closed position to a fully open position. The gasket is configured to seal the drink opening in the closed position.

29 Claims, 8 Drawing Sheets

(52) U.S. Cl.
CPC ..... *B65D 43/02* (2013.01); *B65D 43/0225* (2013.01); *B65D 43/163* (2013.01); *B65D 47/0857* (2013.01); *B65D 47/0895* (2013.01); *B65D 47/32* (2013.01); *B65D 51/18* (2013.01); *B65D 2251/009* (2013.01); *B65D 2251/0021* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01); *B65D 2543/00092* (2013.01); *B65D 2543/00296* (2013.01); *B65D 2543/00518* (2013.01); *B65D 2543/00555* (2013.01)

(58) Field of Classification Search
CPC ..... B65D 47/08; B65D 47/32; B65D 51/18; B65D 51/20; B65D 51/1661; B65D 51/16; B65D 47/0895; A47G 19/2272
USPC ..... 215/307, 237, 235, 329; D9/450, 449, D9/447, 435; 220/367.1, 254.3, 254.1, 220/810, 259.1, 256.1, 713, 711, 715, 220/714, 293, 288, 254.7, 832, 831
See application file for complete search history.

(56) References Cited

U.S. PATENT DOCUMENTS 3,059,816 A * 10/1962 Goldstein ..... B65D 47/0842 215/235
4,533,058 A * 8/1985 Uhlig ..... B65D 47/0838 215/211
5,240,132 A 8/1993 Tucker
5,358,130 A * 10/1994 Mengeu ..... B65D 47/0838 215/235
5,577,626 A * 11/1996 Henkel ..... B65D 47/0804 215/237
8,833,587 B2 * 9/2014 Forsyth ..... A47G 19/2272 220/254.4
2003/0052126 A1 3/2003 Zettle et al.
2012/0125931 A1 5/2012 Roth et al.

OTHER PUBLICATIONS

Examiner's Report on corresponding foreign application (AU Application No. 2017201442) from the Australian Intellectual Property Office dated Nov. 13, 2017.
Examiner's Report on corresponding foreign application (EP Application No. 17158691.0) from the European Patent Office dated May 29, 2018.
Examiner's Report on corresponding foreign application (AU Application No. 2017201442) from the Australian Patent Office dated Jun. 25, 2018.
Examiner's Report on corresponding foreign application (JP Application No. 2017-039593) from the Japanese Patent Office dated Mar. 20, 2018.
Examiner's Report on corresponding foreign application (AU Application No. 2017201442) from the Australian Patent Office dated Oct. 22, 2018.

* cited by examiner

DRINKING CONTAINERS AND RELATED METHODS

FIELD OF ART

The present disclosure relates to drinking bottles or containers, and more particularly to lockable closures for drinking bottles and related methods.

BACKGROUND

Drinking bottles, such as water and soda bottles, are lightweight and provide a convenient way to transport beverages. Generally, most drinking bottles are provided with a corresponding cap used to close and sometimes seal the bottle or container. Drinking bottles typically have a screw on cap to allow easy access to the contents in the container. The cap can be a simple cap or one with a drink opening having a lid that covers or seals the drink opening to prevent spillage. When using a lid, the user can pull the structure of the lid on the cap to expose the drink opening, remove the contents, such as by tilting the bottle against the mouth, and then close the lid back over the dispenser opening.

In some prior art bottles, a short drinking spout can be provided around a perimeter of the opening, which serves as the drinking area, and engaged to the lid in the closed position. The drinking spout may be uncomfortable to a user's lips because of its short length, which is typically fixed, and small diameter when drinking. Furthermore, pulling the lid to the open position may be inconvenient.

SUMMARY

An aspect of the present disclosure provides a lockable lid assembly for use with a drinking bottle. The lid assembly allows for the drinking bottle with a comfortable drinking surface to be re-closed and resealed. In addition, the cap assembly provides the ability to lock the cap assembly into the closed and sealed position.

A further aspect of the present disclosure includes a lockable lid assembly for a drinking bottle, which can comprise a lid housing, a flap, and a gasket.

The lid housing can have a top wall, a drink opening extending through the top wall, a rim extending above the top wall, and at least one notch located in an inner surface of the rim.

The rim has an outer or exterior surface and an inner surface, viewed relative to a central part or the drink opening on the cap or lid assembly.

The flap can be rotatably coupled to the top wall and comprise a flexible portion or extension and at least one locking lug projecting from the flexible portion and configured to engage the at least one notch in a closed position. The flap can be rotatable from the closed position to a fully open position.

The extension can extend from a base portion of the flap.

The gasket can be secured to the flap and configured to seal the drink opening in the closed position.

The flap can further comprises a tab coupled to the extension or flexible portion. The tab can be movable from a locked position to an unlocked position to disengage the at least one locking lug from the at least one notch when a force is applied to an engaging surface of the tab in the locked position.

The tab can extend beyond the rim.

The tab can have an elongated generally horizontal element or first component and a generally vertical element or second component extending from the first component. The vertical element can have an inner surface and an outer surface, relative central part of the lid assembly. The first component may be referred to as a base portion and the second component may be referred to as an extension.

The flexible portion can be deflected a distance greater than a height of the at least one locking lug in the unlocked position.

The at least one locking lug can be located adjacent the tab.

The at least one locking lug can be a pair of locking lugs located at opposite sides of the flexible portion.

The at least one locking lug can be rounded.

An angle between a surface of the at least one locking lug and a surface from which the at least one locking lug protrudes can be greater than 90 degrees.

The flap can further include a base portion or first component coupled to the flexible portion, also called extension or second component.

The gasket can be secured to the base portion.

The flap can be locked in the fully open position.

A male detent can extend from the base portion and engage a hold-open channel defined in the top wall of the lid housing.

The flap can further comprise a pair of legs extending from the base portion.

The flap can be pivotable about the top wall by a pivot extending into the top wall from each leg.

The pivot can extend into a pair of pivot holes formed in side surfaces of the top wall.

The pivot holes can extend through protuberances formed in the lid housing to an edge of the lid housing.

The flap can further comprise a rotation hole extending through the base portion, and can be pivotable about the top wall by a pin extending through the rotation hole and a pair of pivot holes extending through the lid housing.

The gasket can comprise a drink opening seal extending into the drink opening to form a seal at a perimeter of the drink opening.

A vent aperture can extend through the top wall.

The gasket can further seal the vent aperture in the closed position.

The rim can extend above a perimeter of the top wall.

A cutout can be formed at an edge of the rim.

The tab can extend over the cutout in the locked position and the unlocked position.

The tab can extend beyond the cutout.

The at least one notch can be located above the drink opening.

The drink opening can extend toward the rim.

A depression can be formed in the top wall.

The flap can be received in the depression.

The flap can be substantially flush with the top wall in the closed position.

A sidewall can extend below the perimeter of the top wall, and one or more threads can be formed around the sidewall to attach to an open end of a container.

Another aspect of the present disclosure includes a lid assembly, which can comprise a lid housing, a flap and a gasket.

The lid housing can have an upper portion and a lower portion separated by a barrier.

A drink opening can extend through the barrier.

A notch can be located in a wall of the upper portion

The flap can be rotatably coupled to the barrier and comprise a locking lug engaging the notch in a closed position.

The flap can be rotatable from the closed position to a fully open position.

A gasket can be coupled to the flap and form a seal with the drink opening in the closed position.

The flap can be deflectable from a locked position to an unlocked position to disengage the locking lug from the notch when a force is applied to the flap in the locked position.

A vent aperture can extend through the barrier.

The gasket can seal the vent aperture in the closed position.

The flap can comprise a second locking lug engaging a second notch in the wall of the upper portion. The notches can be spaced apart adjacent an outer edge of the wall.

Another aspect of the present disclosure includes a method of using the lid assembly, in which the method can comprise: deflecting a flexible portion of a flap rotatably coupled to a top wall of a lid housing; disengaging a locking lug from a notch defined in an inner surface of a rim, the rim projecting from the top wall of the lid housing; rotating the flap from a closed position towards an open position; and removing a drink opening seal formed between a gasket coupled to the flap from a drink opening extending through the top wall of the lid housing.

The flexible portion or extension of the flap can be deflected by pushing against a tab of the flap.

The tab can extend beyond the rim a distance greater than a height of the locking lug.

A seal between a vent aperture extending through the top wall and the gasket can be removed when the drink opening seal is removed.

A still further aspect of the present disclosure is a drinking bottle assembly comprising a lid assembly comprising a lid housing having a top wall, a drink opening extending through the top wall, a rim extending above the top wall comprising an external or outer rim surface and an inner rim surface, and at least one notch located on the inner surface of the rim; a sidewall extending from the rim; a flap rotatably coupled to the top wall and comprising a flexible portion and at least one locking lug projecting from an external or outer surface the flexible portion and engaging the at least one notch in a flap closed position, the flap being rotatable from the closed position to an open position; a gasket secured to the flap and sealing the drink opening in the flap closed position; and wherein the side wall is sized and shaped to couple to a container comprising a closed end and an open end.

The flap can further comprise a tab extending from the flexible portion, the tab can be movable to disengage the at least one locking lug from the at least one notch.

The tab can extend radially beyond the exterior rim surface or outer surface of the rim.

The flexible portion or second component can be deflected a distance greater than a height of the at least one locking lug.

The at least one locking lug can be located adjacent the tab.

The at least one locking lug can be a pair of spaced apart locking lugs.

The flap can further includes a base portion coupled to the flexible portion, the gasket can be secured to the base portion.

A male detent can extend from the base portion and can engage a female detent on the top wall of the lid housing to retain the flap in an open position.

The flap can further comprise a pair of legs extending from the base portion, the flap can be pivotable about the top wall by a pivot elements extending into the top wall from each leg.

The pivot elements can extend into a pair of pivot holes formed in side surfaces of the top wall.

The pivot holes can extend through protuberances to an edge of the lid housing.

The flap can further comprise a rotation hole having a pivot pin extending therethrough and through a pair of pivot holes on the lid housing.

The gasket can comprise a drink opening seal extending into the drink opening to form a seal at a perimeter of the drink opening.

A vent aperture can extends through the top wall and the gasket can further seals the vent aperture in the closed position.

The rim can extend above a perimeter of the top wall.

A cutout can form at an edge of the rim and the tab can extend over the cutout in the locked position.

The at least one notch can be located above the drink opening.

The drink opening can have a perimeter defined in part by the rim.

A depression can be formed in the top wall and the flap can be received in the depression.

The sidewall of the lid assembly can include external threads or internal threads for threadedly engaging an open end of a container.

Yet another aspect of the present disclosure is a drinking bottle assembly comprising a lid housing having a upper portion and a lower portion separated by a barrier, a drink opening extending through the barrier, a vent aperture extending through the barrier, and a notch located on an inner wall of the upper portion; a flap rotatably coupled to the barrier about a pivotable hinge and comprising a locking lug engaging the notch in a closed position, the flap being rotatable from the closed position to an open position; and a gasket coupled to a perimeter defining an opening on the flap and forming a seal with the drink opening and the vent aperture in the closed position.

The flap can be deflectable from a locked position to an unlocked position to disengage the locking lug from the notch when a force is applied to the flap in the locked position. Optionally, the base portion of the flap can also deflect from the locked position.

The vent aperture can be located between the drink opening and the pivotable hinge.

The flap can comprise a second locking lug engaging a second notch on the inner wall of the upper portion, and the two notches can be spaced apart adjacent an outer edge of the wall.

The disclosure further includes a method of using a drinking bottle assembly, the method comprising: deflecting a flexible portion of a flap rotatably coupled to a top wall of a lid housing; disengaging a locking lug on the flap from a notch on an inner surface of a rim, the rim projecting from the top wall of the lid housing; rotating the flap from a closed position towards an open position; and removing a drink opening seal formed on a gasket connected to the flap from a perimeter of a drink opening extending through the top wall of the lid housing.

The method can further comprise pushing against a tab of the flap to deflect the flexible portion of the flap.

The method wherein the tab can extend radially beyond an external surface of the rim.

The method can further comprise removing a seal between a vent aperture extending through the top wall and the gasket when the drink opening seal is removed.

Method of manufacturing the bottle assembly, the lid assembly, the container or base, or combinations thereof are within the scope of the present disclosure.

BRIEF DESCRIPTION OF THE DRAWINGS

These and other features and advantages of the present devices, systems, and methods will become appreciated and better understood with reference to the specification, claims and appended drawings.

DETAILED DESCRIPTION

Figure 1:
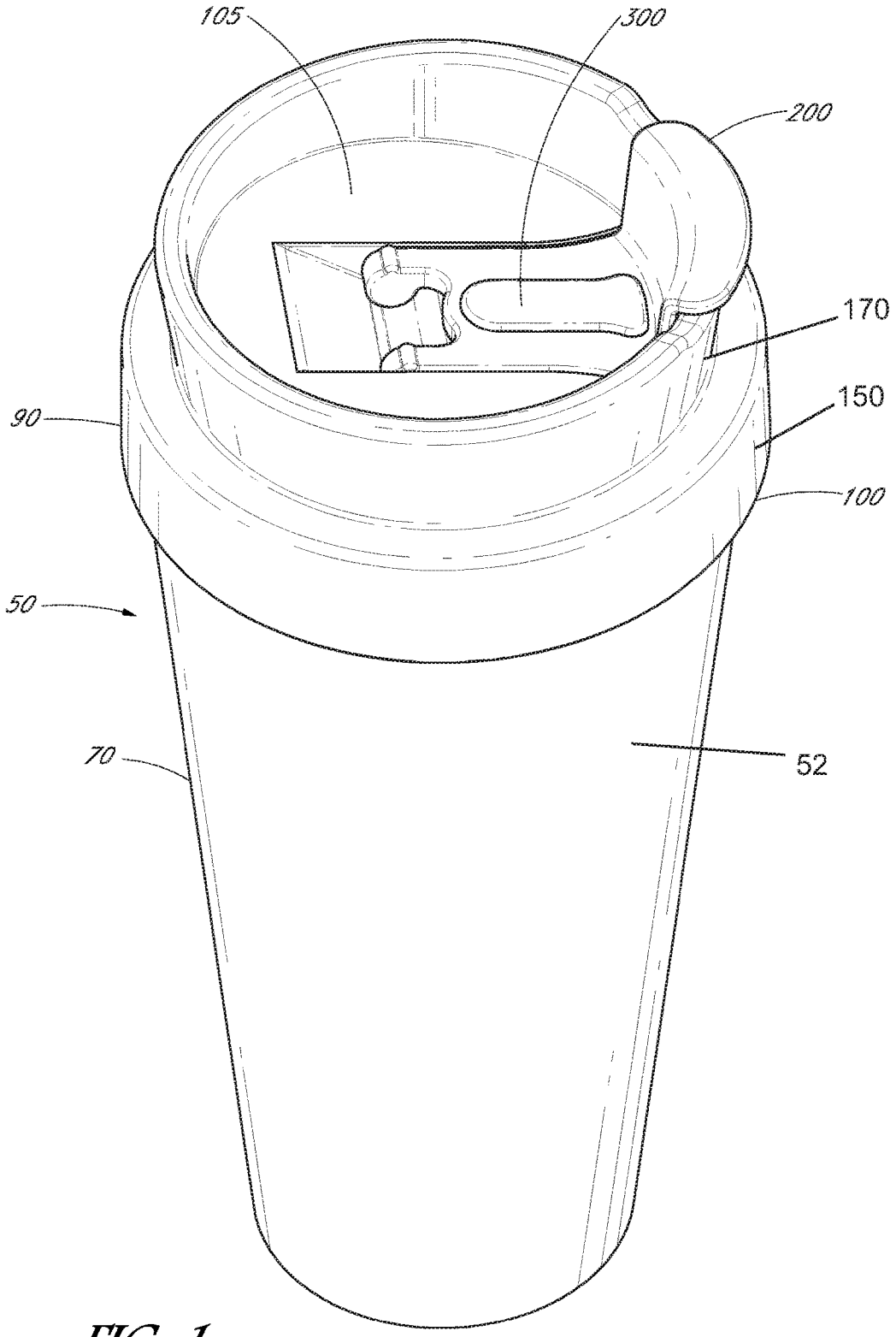
FIG. 1 illustrates a perspective view of a drinking bottle or container assembly according to an embodiment of the present disclosure in a closed position.

The detailed description set forth below in connection with the appended drawings is intended as a description of the presently preferred embodiments of drinking bottles or drinking dispenser and cap assemblies for use with drinking bottles provided in accordance with aspects of the present devices, systems, and methods and is not intended to represent the only forms in which the present devices, systems, and methods may be constructed or utilized. The description sets forth the features and the steps for constructing and using the embodiments of the present devices, systems, and methods in connection with the illustrated embodiments. It is to be understood, however, that the same or equivalent functions and structures may be accomplished by different embodiments that are also intended to be encompassed within the spirit and scope of the present disclosure. As denoted elsewhere herein, like reference numerals are intended to indicate like or similar elements or features.

FIG. 1 is a perspective view of a drinking bottle assembly 50 according to an embodiment of the present disclosure. The drinking bottle assembly 50 can include a container 70 and a cap or lid assembly 90 adapted for closing an open end, such as an opening or mouth, of the container 70. The container 70 can also be referred to as a base comprising a body 52 having an open end and a closed end and defining an internal or interior cavity accessible through the open end and configured to contain fluid therein. The drinking bottle assembly may optionally be referred to simply as a drinking bottle.

As used herein, the term interior or inside and exterior or outside are related to a central portion of the structure or element in question. Thus, an exterior surface is a surface that is further away from the central portion than an interior surface of the same article.

The lid assembly 90 can be removably attached to the container 70. In one example, an engaging portion of the lid assembly 90 can be threadedly engaged to the container 70 at the open end to secure the lid assembly 90 to the container 70. The lid assembly 90 can be internally or externally threaded to engage corresponding inside or outside threads of the open end of the container 70. The lid assembly 90 can also be coupled to the container 70 by other attachment or fastening means, such as by a snap fit engagement or by a tapered fit in which the lid assembly and the bottle opening are providing with the same draft angle to form a compressive fit.

FIG. 1 shows the drinking bottle 50 in a closed position in which contents, such as a liquid or a fluid replacement drink, are sealed inside the drinking bottle 50. In the open position, the contents inside the drinking bottle 50 can be accessed whereas in the closed position, the contents inside the drinking bottle 50 cannot be dispensed. In the present embodiment, the bottle 50 is in the open position when the lid assembly 90 is completely removed from the bottle 70 or when a flap 200 on the lid assembly 90 is manipulated or activated to open a drink opening 110 (FIG. 4), as further discussed below.

The lid assembly 90 of the drinking bottle 50 can include a lid housing 100 comprising a top wall 105, a rim 170, and a sidewall 150. The sidewall 150 defines a perimeter engaging the opening or open end of the container 70 and the flap 200 is rotatably hinged to a hinge part on the top wall 105 to operatively close or open the drink opening 110 on the cap assembly, as further discussed below. The rim has an outer surface and an inner surface, viewed relative to a central part or the drink opening on the cap. The flap 200 can be provided with a gasket 300, which is partially shown in FIG. 1, to seal the drink opening so as to store the contents in the drinking bottle 50 in the closed position. Because the position of the flap 200 determines the state of the drinking bottle 50, the drinking bottle 50 is in the closed position (FIG. 1) when the flap 200 is in the closed position and the drinking bottle 50 is in the open position when the flap 200 is not in the closed position, as further discussed below.

Figure 2:
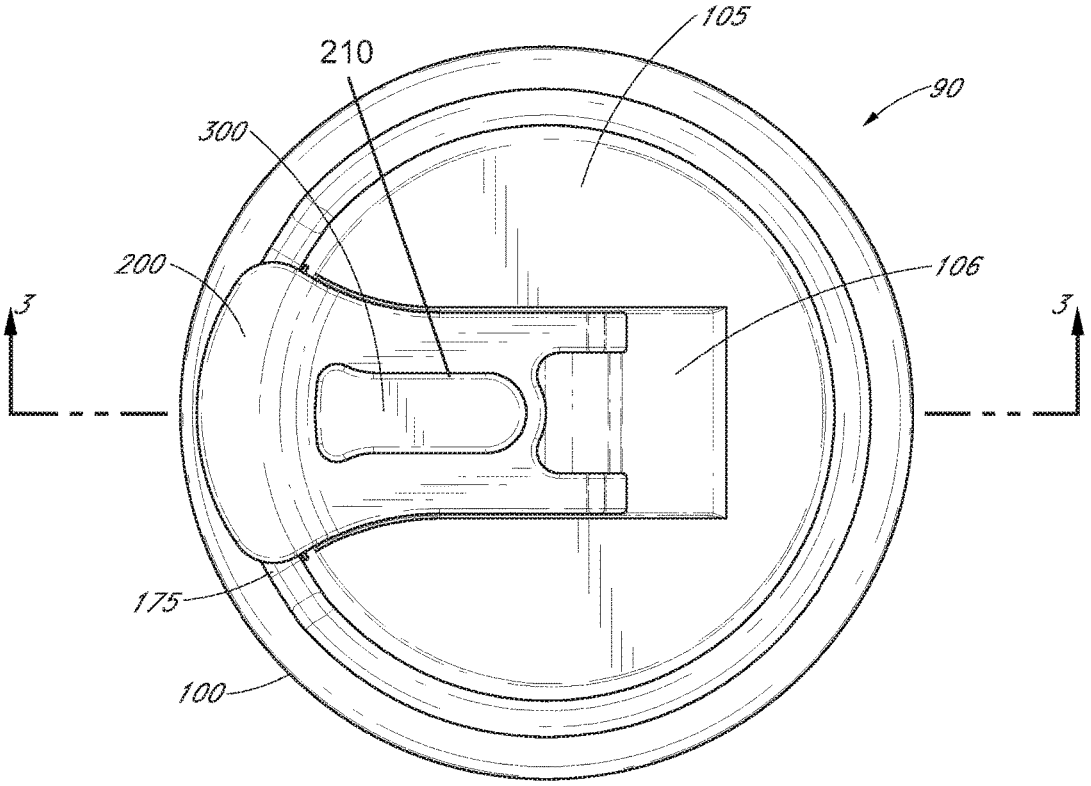
FIG. 2 illustrates a top view of a lid assembly according to one embodiment of the present disclosure of the drinking bottle assembly of FIG. 1 in the closed position.
Figure 3:
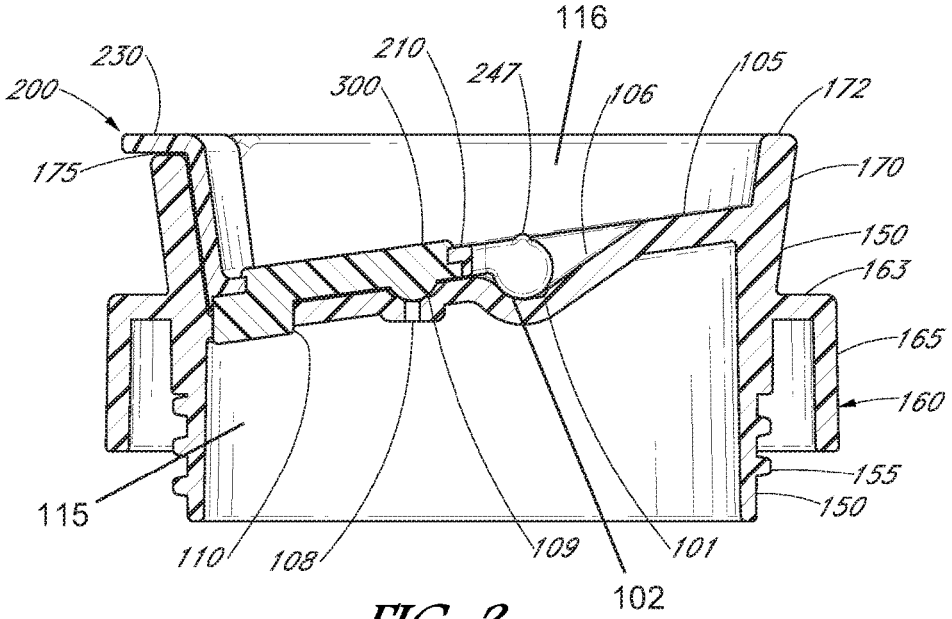
FIG. 3 illustrates a cross-sectional side view of the lid assembly of FIG. 2 along lines 3-3.

FIG. 2 illustrates a top view of the lid assembly 90 of FIG. 1 and FIG. 3 shows a cross-sectional side view of the lid assembly 90 taken along line 3-3 of FIG. 2. FIG. 3 shows a cross-sectional view of the lid housing 100, the flap 200, and the gasket 300.

With continued reference to the lid assembly 90 of FIGS. 2 and 3 and together with FIG. 1, the lid assembly 90 comprises a housing 100 that can include a rim 170 and a sidewall 150 having the top wall 105 bisecting therebetween. The rim 170 and the sidewall 150 can extend in opposite directions from the top wall 105 to respectively define an upper portion or chamber 116 and a lower portion or chamber 115. That is, the top wall 105 can act as a barrier separating the lid housing 100 into the lower portion 115 cooperatively defined by the sidewall 150 and the barrier of the top wall 105, and the upper portion 116 cooperatively defined by the rim 170 and the barrier of the top wall.

In an example, the top wall 105 is generally planar and wherein the plane defined by the top wall is slanted relative to a lengthwise axis of the drinking bottle 50 such that a section of the rim 170 has a taller or higher wall surface than another section of the rim 170, which has a relatively shorter wall surface due to the slanted planar surface of the top wall. Similarly, the sidewall 150 has a section that is taller or has a higher wall surface than another section of the sidewall 150, which has a relatively shorter wall surface due to the slanted planar surface of the top wall. In other examples, the top wall 105 bisects the rim and the sidewall along a horizontal plane, or a plane that is perpendicular to the lengthwise axis of the drinking bottle.

Figure 8:
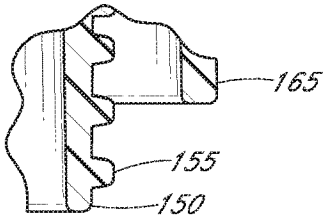
FIG. 8 illustrates an enlarged sectional view of the lid assembly of FIG. 6 taken along circled portion 8-8.

The sidewall 150 may be circular in circumference so that, for example, the lid housing 100 can be twisted into or over the open end of the container 70. The sidewall 150 may have external threads 155 located outside of the sidewall 150 as shown in FIGS. 3 and 8 to engage internal threads formed at the open end of the container 70. Alternatively, the threads 155 on the cap assembly 90, such as on the sidewall 150, may be located on the inside surface of the sidewall 150, such as internal threads, to threadedly engage external threads at the open end of the container 70. A liquid tight seal can be formed by the threaded engagement between the container 70 and the housing 100. The lid assembly 90 can be made from plastic, such as from a hard thermoplastic polymer like TRITAN copolyester, polycarbonate (PC), acrylonitrile butadiene styrene (ABS), polyamides (PA). The list is exemplary only and not limiting as other hard plastic materials can be used. Optionally, the cap assembly may include two or more different polymer materials formed by insert molding, over-molding, or co-molding to vary the material makeup or physical characteristics of the cap assembly, to create different surface appearance, and/or to facilitate manufacturing or assembly. For example, the cap housing may be made from one plastic material and the flap can be made from a different plastic material. This will allow the stiffness or flexibility of the flap, as an example, to be different from the cap housing. The container 70 may be made from a plastic material, such as a transparent, opaque or semi-opaque material so that the contents can be viewed through the wall layer of the container. The container 70 can alternatively be made from glass or metal, such as stainless steel. In some examples, the container 70 can be made with two layers for insulation, such as a double-wall stainless steel base or a double-wall plastic base.

An O-ring or a gasket can be provided between the lid housing 100 and the container 70 to seal the contents inside the internal cavity of the container 70. The lower portion 115 and the internal cavity of the container 70 can be partially or completely sealed off, such as by a liquid tight seal, until the drinking bottle 50 is opened or the flap 200 transitions from the closed position to the open position.

A skirt or cover 160 can extend over at least part of the threads 155 from the side surface of the lid housing 100, such as the sidewall 150 or the rim 170, to cover a seam formed between the opening of the container 70 and the lid assembly 90 when the two are attached together. The cover 160 can be provided with external surface features to enhance gripping by a user when holding the drinking bottle 50 or when attaching, such as by rotating, the lid assembly 90 to the container 70. The surface features can include knurls, cutouts, bumps, grooves, or combinations thereof. The cover 160 can include a horizontal portion 163 extending from the sidewall 150 and a vertical portion 165 projecting from the perimeter of the horizontal portion 163. The inside surface of the horizontal portion 163 can act as a stop for the upper edge of the open end of the container 70 when assembling the lid assembly 90 to the container. The exterior surface features can be provided on the vertical portion 165.

The rim 170 can extend from the top wall 105 to form a drinking surface. The rim 170 can be circular to form a circular drinking surface comfortable for a mouth of a user drinking from the drinking bottle 50 or for pouring contents out the base 70. The rim 170 can also extend longitudinally and radially to form tapered drinking surface. That is, the rim 170 can flare outwardly to enhance pouring the contents out of the drinking bottle 50 or a drinking experience for the user. Other parts of the rim can fare inwardly to create variable surface appearance.

Knurls, bumps, or grooves can optionally be provided on the inside surface of the rim 170 next to the drink opening 110 to create a roughened flow pattern as fluid exits the drink opening. This can help to aerate the drink to possibly enhance the drinking experience. A cutout 175 can be provided at the edge 172 of the rim 170 above the drink opening 110. If the edge 172 of the rim defines a plane, the cutout 175 can be recessed from the plane to accommodate the lip 230 of the flap 200. The cutout 175 can have two radially disposed ends and a recessed edge 60 (FIG. 6) located between the two ends. In another example, the cutout 175 for accommodating the lip 230 can have a complex cure without distinct sides or edges.

In an example, the cutout 175 can have opposite radially disposed ends forming gradual slopes towards recessed edge to provide a smooth drinking surface. When the flap 200 is rotated away from the drink opening 110 to expose the cutout 175, the cutout can serve as a visual queue for where to place the lips to drink from the drinking bottle 50. The width of the cutout 175 can be sufficiently wide to support tab or lip 230 of the flap 200. Further details of the flap 200 will be discussed further below. The depth of the cutout 175 can be such that in the closed position, the upper surface of the tab 230, elevation-wise, can be substantially flush with the edge 172 of the rim 170 to provide a smooth appearance. As shown in FIG. 3, a portion of the lip or tab 230 of the flap 200, such as the radial edge of the tab, can extend radially of the exterior surface of the rim 170 to provide a push point or contact area for pushing or prying against to open the flap 200, as further discussed below.

A depression or cavity 106 can be formed in the top wall 105 to receive the pivot end of the flap 200. Optionally the depression 106 can be omitted and the flap 200 can be positioned above a generally planar surface of the top wall, which would lead to some if not all of the structure of the flap to extend outwardly from the top wall a greater amount than when the depression 106 is included. Within the depression 106, one or more recessed sections or areas, such as a first recessed section 102 and a second recessed section 109, can be provided to accommodate surface features of the flap 200, as further discussed below. A gasket 300 can be affixed to the body of the flap around an opening 210 formed with the flap. The gasket 300 can be made from a rubber material, an elastomeric material, or from a thermoplastic elastomer and can snap into structural features on the flap and into the opening 210 of the flap. Once snapped into place, the gasket 300 can be bonded or glued to the flap. In other examples, the flap and the gasket are formed by over-molding or insert-molding. By securing the gasket and the flap components together, such as by bonding or by over-molding, one or the other component is less prone to be misplaced or lost. In an example, the gasket 300 is made from a silicone rubber material. The flap 200 and the gasket 300 can be inset in the depression 106 such that in the closed position, the flap 200 can be flush or substantially flush with the top wall 105. This can provide the top wall with a planar appearance.

The shape of the depression 106 can closely resemble at least part of the contour of the flap 200 to present a smooth appearance when the flap 200 and the gasket 300 are seated inside the depression 106. Some part of the flap 200, the gasket 300, or both can project axially outwardly of the top wall when the flap 200 is in the closed position. The shape of the depression 106 can have an outer perimeter with a constant width near the anchor end 56 depression and extending towards an aperture 108 in the top wall 105, which acts as a vent. The width of the depression 106 can gradually increase around the drink opening 110 towards the drink end 58 of the depression 106. The flared drink end 58 of the depression can be sized and shaped to accommodate a corresponding flared end on the flap 200, which can be flared to overlap and cover the drink opening 110. Optionally, the width of the depression 106 can be generally constant or can vary beginning from the anchor end 56 or somewhere before the vent aperture 108. In general, by flaring the width of the depression 106 at the drink end 58, the opening size of the drink opening 110, such as the width of the drink opening, can be increased relative to the width at the anchor end 56.

Figure 4:
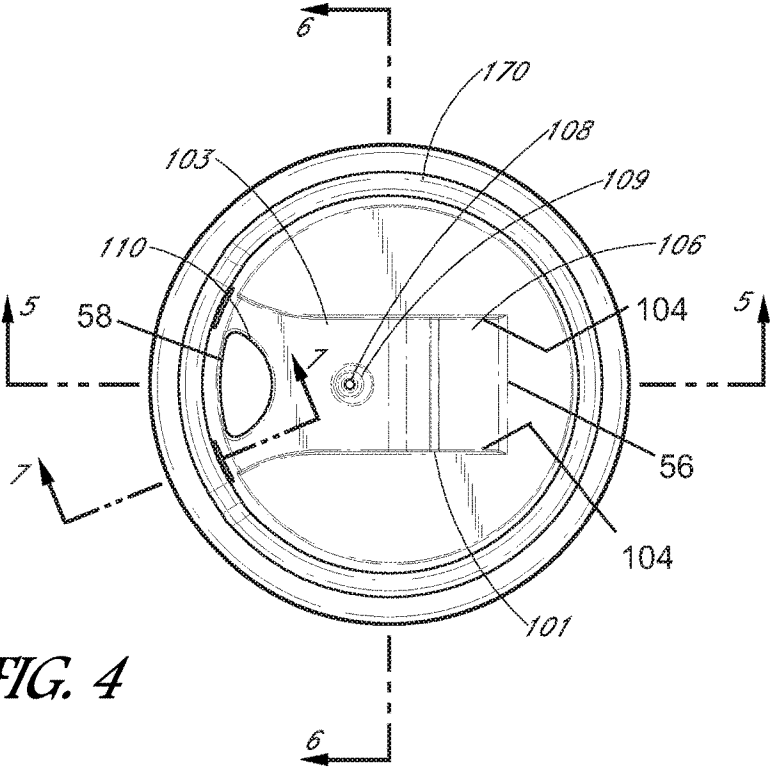
FIG. 4 illustrates a top view of the lid assembly of FIG. 2 shown without the flap.

The drink opening 110 can extend through the top wall 105 in the depression 106 to allow contents, such as fluid, inside the container 70 to pass through the top wall 105. Fluid can enter and exit the container 70 through the drink opening 110. The drink opening 110 can be formed adjacent the rim 70 to allow fluid inside the container to flow through the drink opening 110 when the user tilts the drink container 50 to access the fluid therein. The drink opening 110 can be sized large enough for a straw to pass through into the container 70 so that a user can optionally access the contents using the straw. In an example, the drink opening 110 can be round in shape. As shown in FIG. 4, the drink opening 110 is semicircular or semi-elliptical in shape having an edge of the drink opening 110 defined by the rim 170 or is located in tight proximity to the rim 170 but having no part of the perimeter of the drink opening defined by the rim 170.

The aperture 108 previously alluded to can act as a vent and can be called a venting aperture. The aperture 108 can form through the top wall 105 in the depression 106 away from the drink opening 110 to allow venting when the drink opening 110 is opened and the bottle is tilted. The aperture 108 allows air to enter the container 70 as fluid exits the container 70 through the drink opening 110. The aperture 108 can be smaller in dimension than the drink opening 110 and located away from the drink opening 150 to decrease or prevent the likelihood of fluid passing through both the aperture 108 and the drink opening 110 when the drinking bottle 50 is tilted to access the fluid inside the container. For example, whereas the drink opening 110 can be located near the rim 170, the aperture 108 can be located more centrally on the top wall 105. The shape of the aperture 108 can be round with other shapes contemplated.

A first recess or concave cavity 102 and a second recess or concave cavity 109 are provided in the depression 106 of the top wall 105. The first and second recesses 102, 109 can be similar in shape or be different to accommodate similar or different shaped structures of the flap 200. As shown, the first recess 102 is located further away from the drink opening 110 than the second recess to receive the male detent 247 on the flap 200 and the second recess 109 is located closure to the drink opening 110 to receive a projection or bump on the gasket 300 to seal the vent aperture 108, as further discussed below.

The gasket 300 can seal the drink opening 110 when the flap 200 is in the closed or sealed position. The gasket 300 can extend into the second recess or cavity 109 in the depression 106 to seal the vent aperture 108 in the closed position. Because the gasket 300 is attached to the flap 200, when the flap 200 is in the open position and the gasket 300 rotated, the seals of both the drink opening 110 and the aperture 108 can be broken or un-sealed. Thus, aspect of the present disclosure comprises a drink bottle comprising a base and a cap assembly comprising a top wall with a drink opening and a vent aperture, and wherein a flap is hingedly connected to the top wall about a pivotable hinge and seals both the drink opening and the vent opening in the flap closed position. Wherein rotation of the flap about the pivotable hinge to an open position opens both the drink opening and the vent opening.

Figure 5:
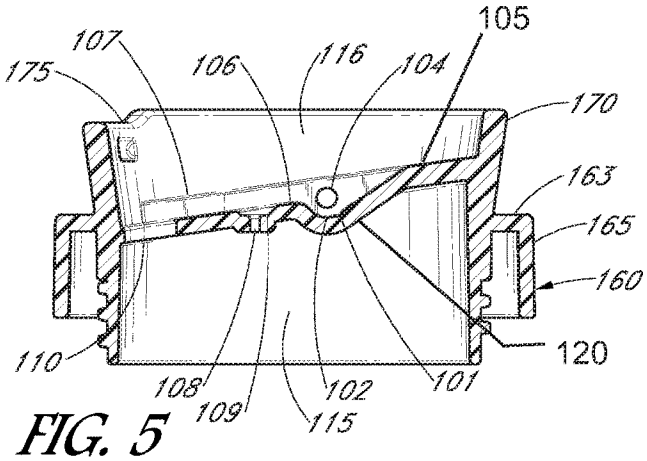
FIG. 5 illustrates a sectional view of the lid assembly of FIG. 4 taken along lines 5-5.

Further details of the lid housing 100 are provided in FIGS. 4-8. Refer initially to FIG. 5, the depression 106 on the exterior of the top wall 105 can include a pair of opposed side surfaces 107 (only one shown) and a pair of pivot holes 104 (only one shown) formed in the side surfaces 107 to receive corresponding pair of pivot elements 250 (FIG. 9) formed with the flap 200 to rotatably couple the flap 200 about an axis defined by the pivot holes 104. The pivot elements 250 can embody pivot pins or pivot stubs that project into the corresponding sockets defined by the pivot holes 104. In some examples, the pivot elements 250 can embody half domes that project into sockets defined by the pivot holes 104. The pivot holes 104 can extend into the side surfaces 107 of the depression 106 and can extend radially towards the rim 170 without penetrating into the lower chamber 115 of the cap housing or lid housing 100. The lower chamber 115 defined by the top wall 105 and the sidewall 150 forms part of an interior space with the container or base 70. Thus, by not penetrating into the lower chamber 115, fluid from inside the base or container 70 cannot leak out the cap housing 100 via the pivot holes 104. In an example, the side surfaces 107 can be provided with a sufficiently thick wall layer so that the pivot holes can recess or form sockets into the wall layer without penetrating into lower chamber 115 of the cap assembly that forms the interior space with the bottle 70.

In an example, one or more elongated protuberances 120 (FIG. 4A) are formed on the top wall 105 so as to define the two pivot holes 104. The elongated protuberances 120 can extend the diameter of the cap assembly or short of the diameter of the cap assembly. The elongated protuberances 120 can extend from the inside surface of the top wall 105.

The two pivot holes 104 can align and together define an axis of rotation for the flap 200. Because the one or more elongated protuberances are longer than the pivot elements 250 on the flap 200, the pivot elements do not penetrate into the space of the lower portion 115.

Within the depression 106, a channel or first recess 102 (FIG. 5) with a curved concave bottom can be formed extending across the depression 106 between the pivot holes 104 to accommodate movements of the flap 200, such as to allow the flap to freely pivot about the pivot holes 104 between the closed position and an open position. In one example, the first recess or channel 102 can have a substantially constant radius of curvature concentric with the pivot holes 104. In another example, the channel 102 can have a curve surface having a complex curve.

One or more grooves 101 or a single elongated groove can extend the width of the depression within the first recess 102 between the pivot holes 104. The one or more grooves 101 can act as female detents and can be sized and shaped to receive one or more male detents 247 formed on the flap 200 so as to retain the flap 200 in a fully open position. The one or more male detents 247 on the flap 200 can engage the one or more female detents 101 in the depression 106 to retain the flap 200 in the open position. The relative positions of the one or more male detents 247 can be adjusted or varied on the two legs 245 of the flap, such as during manufacturing or molding of the flap, so as to control the angular position of the flap 200 relative to the top wall 105 when the flap is rotated before the one or more male detents 247 engage the one or more female detents 101 to retain the flap in the open position. The detents are reversible to allow the flap 200 to close over the drink opening 110, as further discussed below.

As shown in FIG. 4, the location of the pivot holes 104 at or near the anchor end 56 of the depression 106 relative to the vent aperture 108 and the drink opening 110 allows the flap 200, when installed to the pivot holes 104, to seal both the drink opening 110 and the vent aperture 108 in the closed position with the same flap closing motion. Further in that regard, with the same opening motion of the flap 200, both the drink opening 110 and the vent aperture 108 can be exposed for dispensing fluids inside the bottle. In an example, both the flap closing motion and the flap opening motion can involve rotating a flap about a pivotable hinge. As further discussed below, the flap closing and opening motions can further include elastically deforming the flap while concurrently pivoting the flap about a pivotable hinge.

Figure 4A:
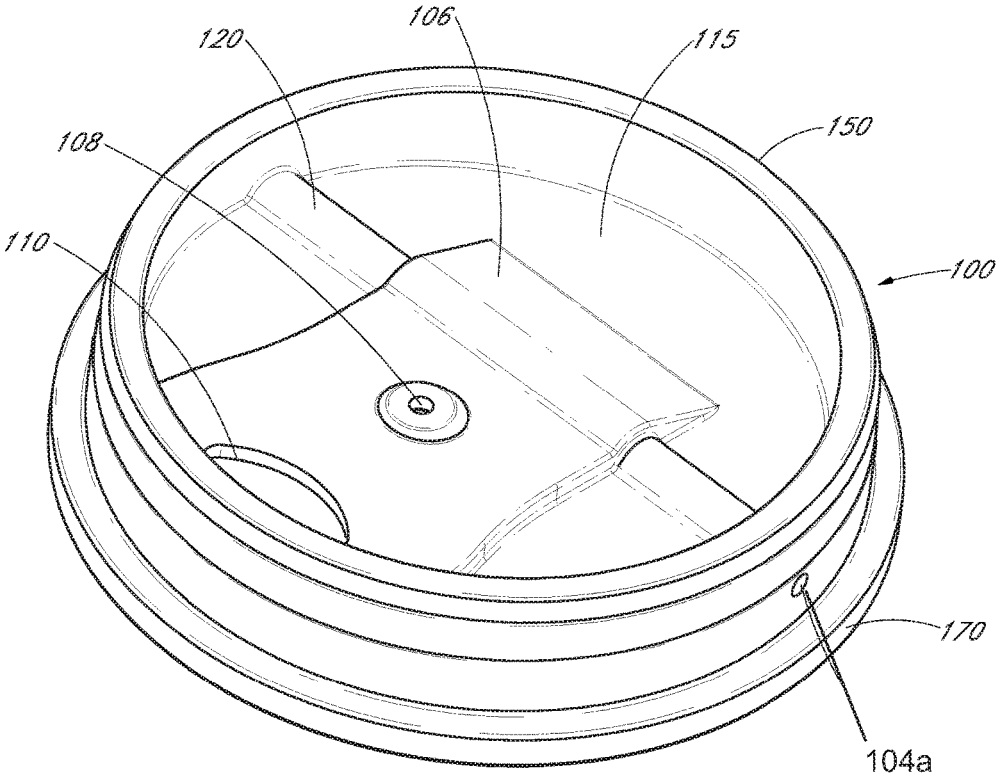
FIG. 4A illustrates a perspective bottom view of a lid housing according an embodiment of the present disclosure.
Figure 11:
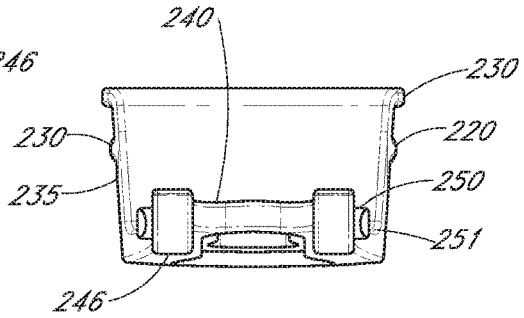
FIG. 11 illustrates a rear view of the flap of FIG. 9 from the perspective of lines 11-11.
Figure 13:
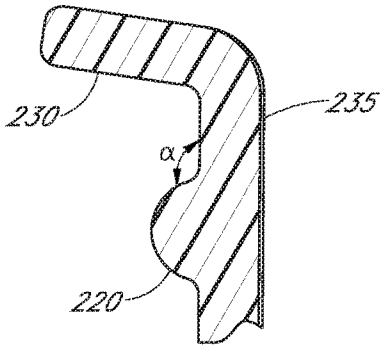
FIG. 13 illustrates an enlarged sectional view of the flap of FIG. 9 taken along lines 13-13.

Referring now to FIG. 4A, an underside perspective view of the lid housing 100 is shown with the protuberances 120 extending radially from the depression 106 to the sidewall 150 or rim 170 of the lid housing 100. The skirt or cover 160 (FIG. 6) has been omitted to more clearly show the sidewall wall 150 and the rim 170. Optionally, the lid housing 100 can be practiced without the skirt 160 as shown. The pivot holes 104 can extend through the protuberances 120 from the depression 106 (FIG. 4) and then outwardly to sidewall 150 and terminating in outlet ports 104*a* formed through the sidewall 150. The pivot holes 104 are aligned or coaxial without any part of the holes breaking through and in fluid communication with the lower portion 115 of the lid housing 100. In other words, the interior space of the lower portion 115 and the pivot holes are not in fluid communication with one another. The pivot elements 250 of the flap 200 can extend into the pivot holes 104 at the depression area 106 (FIG. 4) to rotatably couple the flap 200 to the housing lid 100 as described above. A plug (not shown) can be provided in each exposed outlet ports 104*a* outside the lid housing 100 to prevent dust or debris from collecting inside the pivot holes 104. The outlet ports 104*a* can facilitate manufacturing of the pivot holes 104 through the protuberances by providing means for a core pin or pins to be removed therefrom. Optionally, the protuberances 120 can extend radially and terminate with outlet ports at the rim or within the rim 170.

In another example, the pivot holes 104 and the pivot pins or elements 250 can reverse. For example, the flap 200 can be provided with rotation holes on each end of the legs 245 (FIG. 9) for receiving pins formed with the lid housing 100. In yet another example, a single elongated pin or rod can extend through the outlet ports 104*a* and through the rotation holes formed with the flap to rotatably couple the flap 200 to the lid housing 100. Thus, the flap 200 can rotate about the single elongated pin between the closed position and the open position. In this embodiment, the pin can be secured inside the pivot holes 104 by interference fit or end caps provided at the exposed ends of the outlet ports 104*a*.

Figure 6:
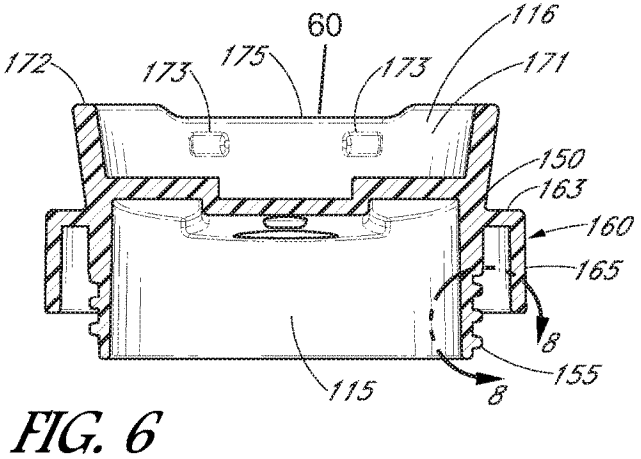
FIG. 6 illustrates a sectional view of the lid assembly of FIG. 4 taken along lines 6-6.
Figure 7:
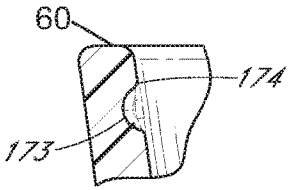
FIG. 7 illustrates an enlarged sectional view of the lid assembly of FIG. 4 taken along lines 7-7.

With reference now to FIG. 6, a pair of spaced apart notches 173 can be formed in or on an inner surface 171 of the rim 170. In an example, the two spaced part notches 173 can be formed above the drink opening 105, elevation-wise. The notches 173 can be located below the cutout 175. In an example, both notches 173 are located inwardly of the two sides of the cutout 175. The notches 173 can be sized and shaped to receive locking lugs 220 (shown in FIG. 9) formed on the flap 200 to secure the flap 200 to the housing 100, such as to the rim 170, in the closed position. As shown in FIG. 7, which is a partial cross-sectional side view taken through one of the notches 173, each notch 173 can have a rounded entrance or tapered inlet 174 on a side of the notch adjacent the recessed edge 60 of the cutout 175. The rounded entrance 174 allows the locking lugs 220 of the flap 200 to slide smoothly in and out of the notches 173 as the flap 200 moves in and out of a closed position, as further discussed below. Each notch 173 can be sized and shaped to closely match the shape and contour of a corresponding locking lug 220 on the flap 200, as further discussed below. In an example, the notches 173 can each have a generally rectangular perimeter and a rounded bottom to receive a corresponding locking lug 220. Other shapes and sizes of the notches 173 and locking lugs 220 are contemplated. For example, the notches 173 can be partially spherical to match dome shaped locking lugs 220. The locking lugs can also have a star shape, a diamond shape, or an elliptical shape.

Figure 9:
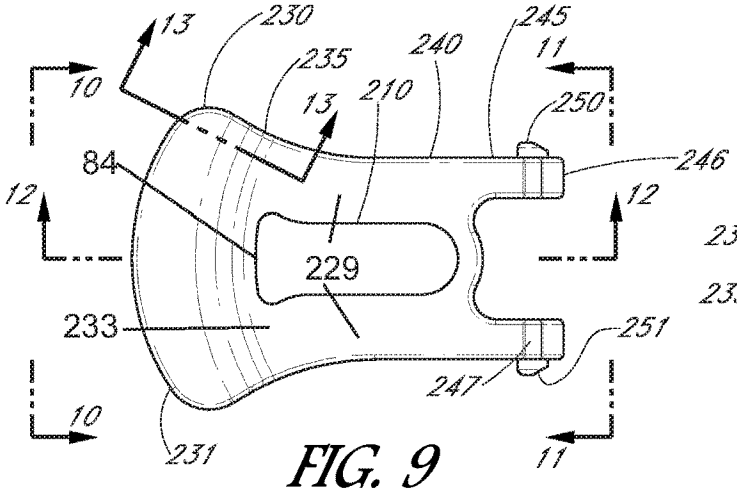
FIG. 9 illustrates a top view of a flap according to one embodiment of the present disclosure of the lid assembly of FIG. 2.

Details of the flap 200 in accordance with aspects of the present disclosure are illustrated in FIGS. 9-13, shown without the gasket 300. As shown, the flap 200 has a body 233 that is shaped as a leaf or an extended or elongated element and comprises a central body section or base 240 having an extension 227 with a tab 230 extending therefrom. Two spaced apart legs 245 extend from the base portion 240 at an end opposite the extension 227. A pivot element 250 can project outwardly of each leg 245, near the free end 246, to engage a corresponding pivot hole 104 on the cap housing 100. A perimeter 84 defining an opening 210 is provided at or near a central portion of the base portion 240 for receiving a gasket 300, as previously discussed. In an example, the perimeter 84 comprises two side edges and two connecting ends. The two connecting ends can be symmetrical or can be different, as shown in FIG. 9. For example, one connecting end can be round whereas the other connecting end can be generally straight. The perimeter 84 can be sized and shaped to receive any number of shaped gaskets. The different shaped ends can increase or decrease the ease of assembly and disassembly of the gasket to the respective end.

Two extended body elements 229 are formed on the base portion 240 by the opening 210. The width of each body element 229 can vary depending on the size of the opening 210 and the overall outer dimension of the body 233 of the flap. The flap 200 can be made of a plastic material capable of deflecting, bending, and is inherently resilient when elastically deformed. The flap 200 can be made with the same thermoplastic material as the cap housing or lid housing 100 or from a different plastic material to thereby have different physical properties. The width of each extended body element 229 can determine the amount of bending or deflection of the base portion when an opening force is exerted on the flap. Thus, the body 233 of the flap 200 can act not only as a lid, but also as a leaf spring. These characteristics of the flap 200 can be used to seal the drink opening 110 of the cap assembly 90, to elastically deform the body 233 to move the flap into the closed position, and to elastically deform the body 233 to move the flap away from the closed position, such as to a fully open position where the male detents 247 engage the female detents 101. For example, the extension 227 can deflect away from the rim 170 and towards the rim to engage the locking lug 220 on the extension 227 with the notches 173 formed on the interior wall surface 171 of the rim 170. Because the extension 227 can deflect, such as along the surface thereof, at the base portion 240, or combinations thereof, it can be called a flexible portion 235.

Thus, without mechanically inter-engaging the flap 200 with the upper edge 172 of the rim 170, without inter-engaging the outside exterior wall surface of the rim 170 with the flap 200, or using interference to grip both the inside and outside wall surfaces of the rim 170, the flap 200 can nonetheless snap into a secured position or closed position to close the drink opening 110 and can snap again to move the flap 200 from the closed position to an open position to expose the drink opening 110, as further discussed below.

The flap 200 can be assembled to the lid housing 100 by extending the free ends 246 of the two legs 240 into the channel or first recess 102 of the depression 106 on the cap housing 100. The legs 245 can elastically bend inwardly towards one another until the pivot elements 250, which can be pivot pins, pivot stubs, or pivot domes, are received in the pivot holes 104 located in the depression 106 on the top wall 105 of the cap or assembly 90. Once the pivot elements 250 are aligned with the pivot holes, the legs 245 can snap back to its original shape or at least move away from one another thereby pivotably coupling the legs 245 of the flap 200 to the lid housing 100. The flap 200 can be hingedly connected, such as pivotably connected, to the top wall 105 of the cap assembly about the pivot elements 250 and the pivot holes 104. Each pivot element 250 can include a chamfered edge 251 at the tip of the pivot element 250 to facilitate inserting the pivot element 250 into the corresponding pivot hole 104.

Figure 10:
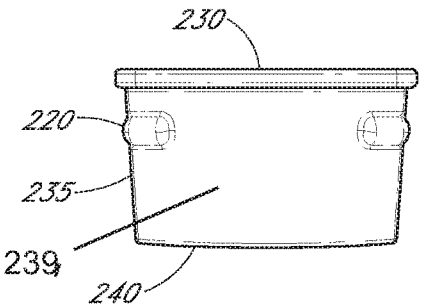
FIG. 10 illustrates an end or front view of the flap of FIG. 9 from the perspective of lines 10-10.

Referring now to FIG. 10, a pair of locking lugs 220 extend outwardly from the outer or exterior wall surface 239 of the flexible portion 235 of the flap 200. The locking lugs 220 can be spaced from one another and can be arranged on the flexible portion 235 to engage the notches 173 formed with, in, or on the inner surface 171 of the rim 170 to secure the flap 200 to the cap housing 100 in the closed position. Thus, the position of the locking lugs 220 can control the position of the flap 200 in the closed position. The position can be selected so as to provide a load on the gasket 300 or sandwich the gasket 300 between the top wall 105 and the flap 200 to seal the drink opening 110 and the vent aperture 108, The engagement between the locking lugs 220 and the notches 173 can be a tight fit to allow very little movement at the flared end of the flap, if any, in the closed position. The engagement between the locking lugs 220 and the notches 173 can also be sized so that a downward force is applied on the gasket 300 to press the gasket into sealing the drink opening 110 and the vent aperture 108 in the closed position. As shown, the locking lugs 220 are arranged on the exterior surface 239 of the flexible portion 235, adjacent the lip or tab 230, to align with the notches 173 on the interior surface 171 of the rim 170. The spacing of the two locking lugs 220 and therefore the notches 173 as well as their relative positions can vary provided they are selected to allow the flap 200 to secure against the rim 170 and provide a load on the gasket 300 against the top wall 105 of the cap housing to seal the drink opening 110 and the vent aperture 108. The locking lugs 220 can be rounded to smoothly enter the notches 173 when the flap 200 is moved towards the closed position, which also facilitates separation when the locking lugs 220 separate from the notches 173 as the flap 200 is moved out of the closed position.

The flexible portion 235 of the extension 227 can be curved to match the contour of the inner surface 171 of the rim 170. In one example, the flexible portion 235 can touch or be seated against the inner surface 171 of the rim in the flap closed position. In another example, the flexible portion 235 can be spaced from the inner surface 171 of the rim 170 in the closed position. The locking lugs 220 of the flexible portion 235 are configured to engage the notches 173 on the interior wall surface 171 of the rim 170 to maintain the flap 200 in the closed position. With reference to FIG. 2, the relative dimensions of the flap 200 as it seats in the closed position and the inside diameter of the rim 170 are such that a slight interference is experienced between the exterior surface 239 of the flexible portion 235 and the rim 170. Said another way, in the closed position, at least part of the body 233 of the flap 200 is under compression. This constraint may be used to press the gasket 300 against the drink opening 110 and the vent aperture 108 to seal the two openings 110, 108. To open the drink opening 110, the radial edge 231 of the tab 230 or the tab 230 itself can be pushed to deflect the extension 227 in the radial inward and axial direction to pivot the flap 200 from the closed position, as discussed further below.

The tab 230 on the flap 200 can extend over the cutout 175 to rest against the recessed edge 60 of the cutout 175 in the closed position, as shown in FIG. 3. In other examples, the tab 230 can be spaced from the recessed edge 60 of the cutout 175 in the closed position. The tab 230 can function as a pressing surface for a user to press or push to bend the flexible portion 235 to disengage the locking lugs 220 from the notch 173. As the tab 230 is pushed, the flexible portion 235 can bend and the base portion 240 of the body 233 can also deflect or bend. Thus, the tab 230 can function like a button to release the flap 200 from the closed position and to then rotate away from the drink opening 110 and the vent aperture 108 to allow the contents inside the bottle 70 to be dispensed.

When the user pushes the radial edge 231 or near the radial edge of the tab 230, movement of the flap 200 is initially resisted by the pivot elements 250 in the pivot holes 104. Additional opening force applied to the engaging surface 231 or tab 230 can cause the flexible portion 230, the base portion 240, or both to deflect elastically until the locking lugs 220 on the extension 227 detach from the notches 173 on the rim 170. The distance required to push the tab 230 and the disengagement force required to remove the locking lugs 220 from the notches 173 can depend on the shape and geometry of the locking lugs 220 and the notches 173, as well as the material, size, and shape of the extension 227 and the base portion 240 of the flap 200. For example, referring to FIG. 13, the larger an escape angle α between a surface of the locking lug 220 and the surface from which the locking lug 220 protrudes, and the smaller the height of the locking lug 220, the less the engagement force can be required to disengage the locking lugs 220 from the notches 173. The thickness, the shape, and the material of the flexible portion 235 can also affect the disengagement force. In one example, a radial edge 231 of the tab 230 extends past the rim 170 a distance greater than the height of the protruding locking lug 220 to ensure that the tab 230 can be pushed far enough radially to disengage the locking lugs 220 from the notches 173. That is, the tab 230 can travel a distance greater than a height of the locking lugs 220 to separate the locking lugs 220 from the notches 173.

Figure 12:
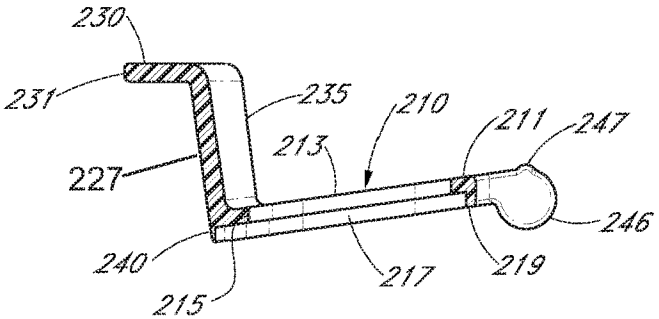
FIG. 12 illustrates a sectional view of the flap of FIG. 9 taken along lines 12-12.

Referring now to FIG. 12, the free end 246 of each leg 245 of the flap 200 can be enlarged to support a larger pivot element 250 and rounded to avoid entanglement or interference with the channel or first recessed area 102 of the depression 106 when the flap 200 is rotated about the pivot elements 250. In an example, the rounded free end 246 of each leg 245 can act as a bearing in the event there is some touching between the free end 246 and the first recessed area 102. A bump or male detent 247 can protrude from a surface of the rounded free end 246 for engaging the female detent 101 in the channel 102 to hold the flap 200 in an open position, such as a fully opened position or to some preset opened position, as previously discussed. In other examples, a plurality of protrusions instead of a single male detent 247 can be located on the free end 246 to allow the flap 200, such as the plurality of protrusions, to be held by the female detent 101 along a multitude of open positions or angular positions prior to reaching the fully open position. The plurality of protrusions can also provide a ratcheting feel or tactile feedback when opening the flap 200.

With reference again to FIGS. 9 and 12, the perimeter 84 of the opening 210 on the flap 200 can be defined through the base portion 240 between a first surface or upper surface 211 and an opposite second surface or lower surface 219. A step 215 can separate the opening 210 into a first cavity 213 and a second cavity 217. A depth of the first cavity 213 can extend between the first surface 211 and the step 215, and a depth of the second cavity 217 can extend between the step 215 and the second surface 219. The step 215 can act as a shoulder between the first cavity and the second cavity. The second cavity 217 can have a similar shape as the first cavity 213 but larger. In other examples, the step 215 can be omitted and only a single cavity is provided within the perimeter 84 through the opening 210. The perimeter 84 of the opening 210 is configured to receive a gasket 300 to secure the gasket to the flap 200 so that when the flap 200 is in the closed position, the gasket 300 can be pressed to seal the drink opening 110 and the vent aperture 108.

Figure 14:
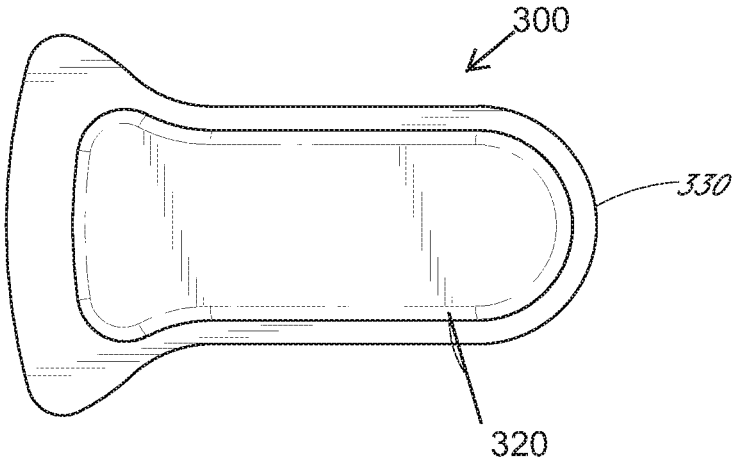
FIG. 14 illustrates a top view of a gasket according to one embodiment of the present disclosure of the lid assembly of FIG. 2.
Figure 15:
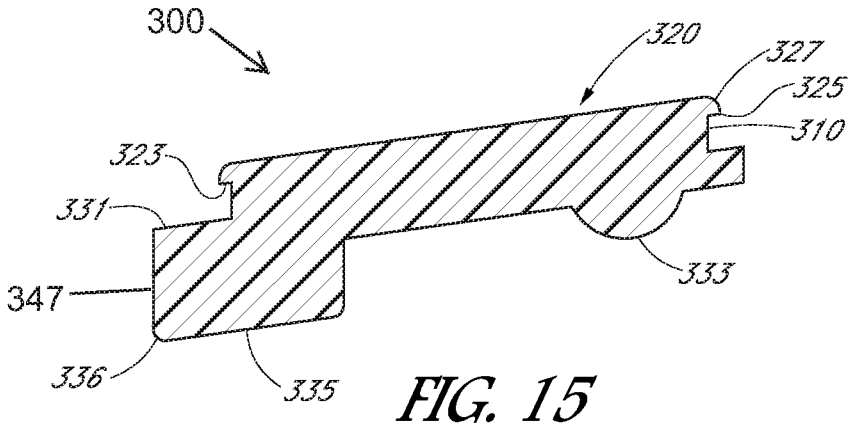
FIG. 15 illustrates a sectional view of the gasket of FIG. 14.
Figure 16:
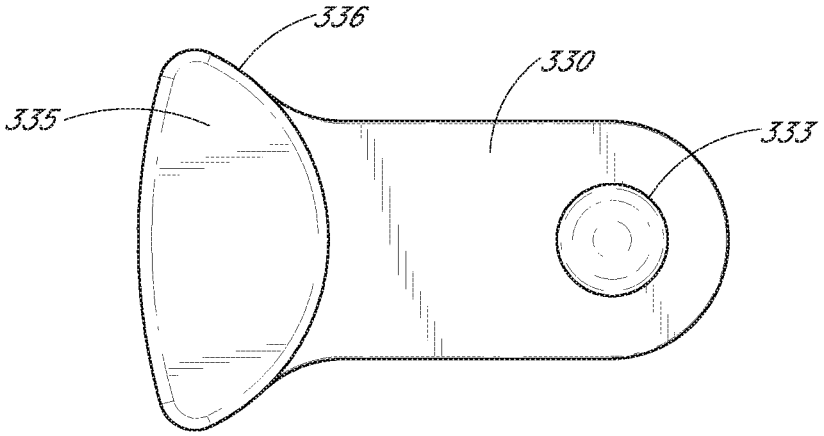
FIG. 16 illustrates a bottom view of the gasket of FIG. 14.

The gasket 300 is shown in FIGS. 14-16. The gasket 300 can include a securing portion 320, a sealing portion 330, and a channel 310 located between the securing portion 320 and the sealing portion 330. The channel 310 can be provided as a continuous race or channel formed around the circumference of the securing portion 320. As shown, the sealing portion 330 is larger than the securing portion 320.

The gasket 300 can be assembled to the flap 200 by inserting either the securing portion 320 or the sealing portion 330 through the opening 210 until the channel 310 is received inside the first cavity 213 of the flap 200 between the step 215 and the first surface 211. The securing portion 320 can be seated against the first surface 211 and the sealing portion 330 can be seated against the step 215 and partially received in the second cavity 217.

The channel 310 of the gasket 300 can have substantially the same shape as the first cavity 213 in the opening 210 of the flap and the size of the channel 310, such as the dimension or diameter, can be slightly larger than, substantially equal to, or slightly smaller than the size of the first cavity 213. The channel 310 can have a thickness that is substantially equal to or slightly less than a depth of the first cavity 213 to ensure that the securing portion 320 and the sealing portions 330 are seated against the first surface 211 and the step 215, respectively. Thus, both the securing portion 320 and the sealing portion 330 can be larger than the first cavity 213 to provide contact against the first surface 211 and the step 215, respectively. In embodiments where no step 215 is present, the sealing portion 330 can seat against the second surface 219.

The securing portion 320 and the sealing portion 330 can extend beyond a perimeter of the channel 310, measured at a base or center wall of the channel. The securing portion 320 has a securing surface 323 configured to contact the first surface 211 of the base portion 240 to prevent or provide a resistance to the gasket 300 from being pulled out from the opening 210 against the securing surface 323. The sealing portion 330 can include a blocking surface 331 configured to contact the step 215 (or the second surface 219 if no step 215 is present) and prevent the gasket 300 from being pulled out from the opening 210 against the blocking surface 331.

A first edge 325 running along an outer perimeter of the securing surface 323 and a second edge 327 opposite the first edge 325 can create a smooth appearance and prevent unintended removal of the gasket 300. Markings or engravings can optionally be applied to the exposed surfaces of the securing portion 320, such as letters, numbers, and/or symbols or logos.

A drink opening seal 335 can extend from the sealing portion 330 to seal the drink opening 110 when the flap 200 is in the closed position. The drink opening seal 335 can sized and shaped to effective seal the drink opening 110. In an example, the drink opening seal 335 can be larger than the drink opening 110 to seal around an outer exterior of the drink opening 110. In another example, as shown in FIG. 3, the drink opening seal 335 extends into the perimeter of drink opening 110 to form a seal with the perimeter of the drink opening 110. The side surface 347 of the drink opening seal 335 that contacts the perimeter of the drink opening 110 can be tapered or can be vertical. An edge 336 extending around the drink opening seal 335 can be rounded or chamfered to facilitate passing the drink opening seal 335 into the drink opening 110 of the cap assembly when the flap 200 is moved towards the closed position from an open position. In other examples, the drink opening seal 335 can sit in the depression 106 and form a face seal outside the perimeter of the drink opening 110.

The sealing portion 330 can also include a vent aperture seal 333 configured to seal the vent aperture 108 in the closed position by forming a face seal against an outside perimeter of the vent aperture 108. The vent aperture seal 333 can be sized and shaped to cover the vent aperture 108 and seat inside the aperture cavity or second recessed section 109 of the depression 106. As shown, the vent aperture seal 333 is dome shaped to match a contour of the aperture cavity 109. In other examples, the second recessed section 109 and the vent aperture seal 333 can embody other geometrical shapes.

In the closed position, the engagement between the locking lugs 220 and the notches 173 and between the pivot elements 250 in the pivot holes 104 force the drink opening seal 335 to seal the drink opening 110 and the vent aperture seal 333 to seal against the vent aperture 108. Said differently, the flap 200 can impart a compressive force to sandwich the gasket 300 between the top wall 105 and the body 233 of the flap 200 to seal the drink opening 110 and the vent aperture 108. Being resilient, the gasket 300 can impart a biasing or spring force against the body 233 of the flap 200 while in the closed position. This spring force can cause the flap 200 to spring open when the locking lugs 220 disengage from the notches 173. The force imparted by the user to deflect the extension 227 by pushing on the tab 230 of the flap 200 also assists to swing the flap to the open position once the locking lugs 220 disengage from the notches 173.

Figure 17:
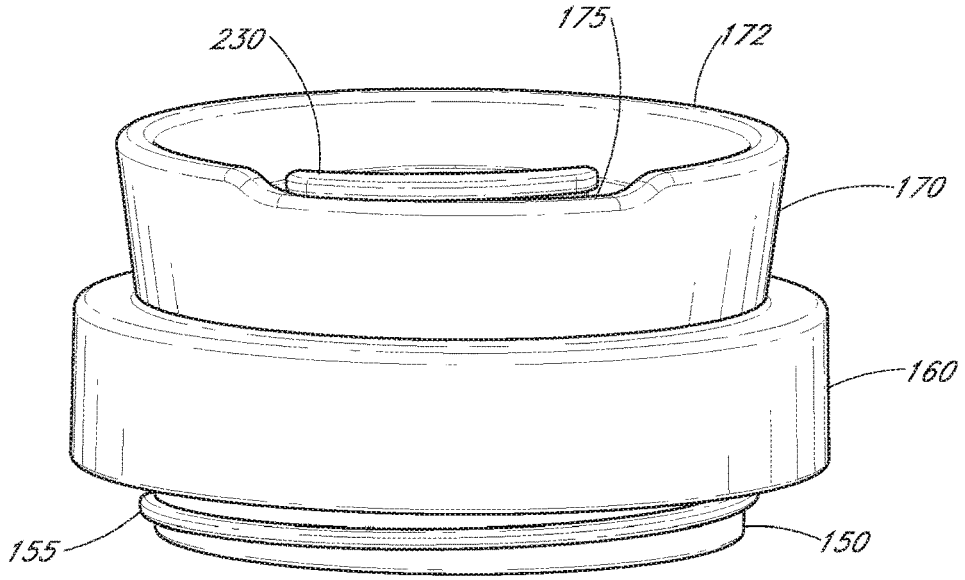
FIG. 17 illustrates an isometric view of the lid assembly of FIG. 2, shown from another perspective.
Figure 18:
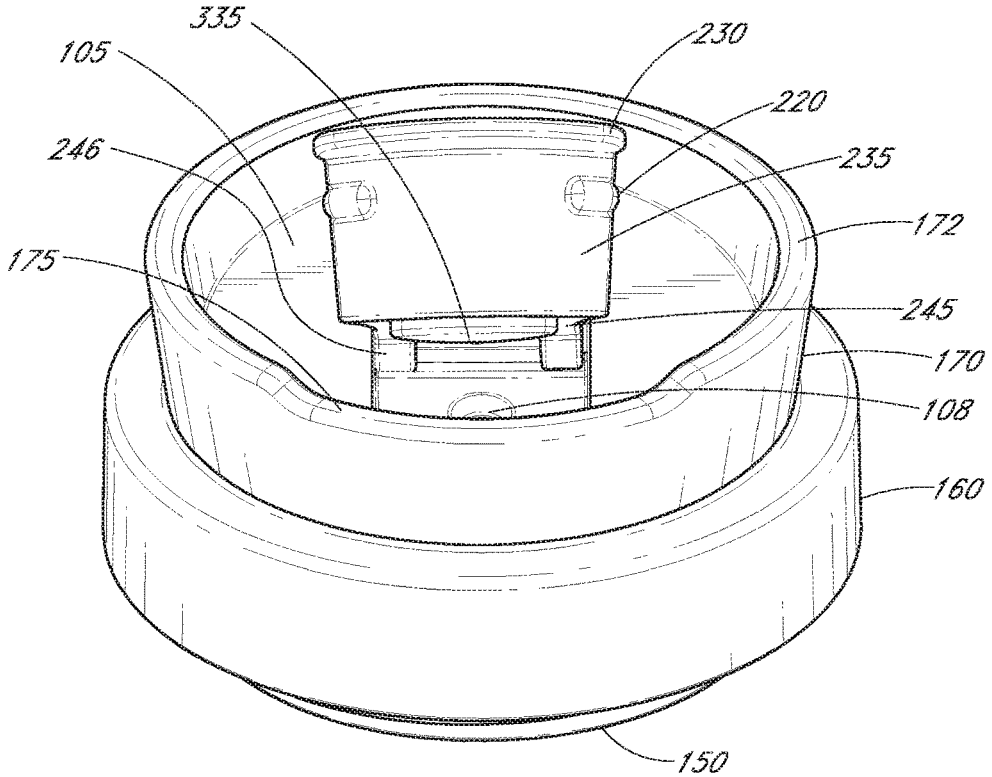
FIG. 18 illustrates an isometric view of the lid assembly of FIG. 17, shown in an open position.
Figure 19:
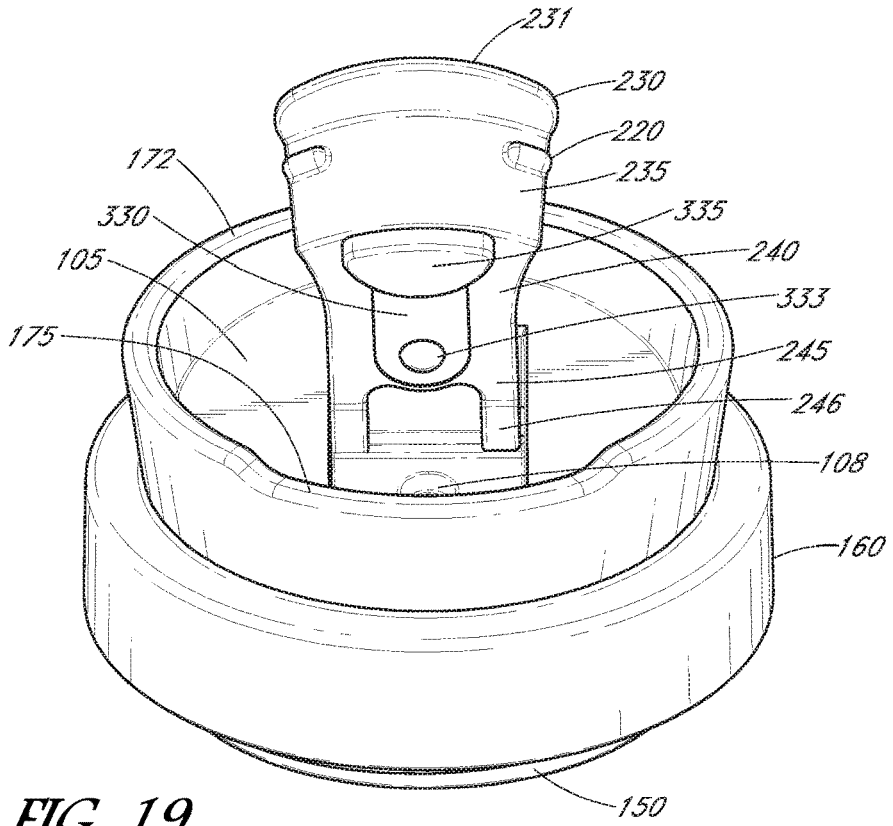
FIG. 19 illustrates an isometric view of the lid assembly of FIG. 17, shown in another open position.
Figure 20:
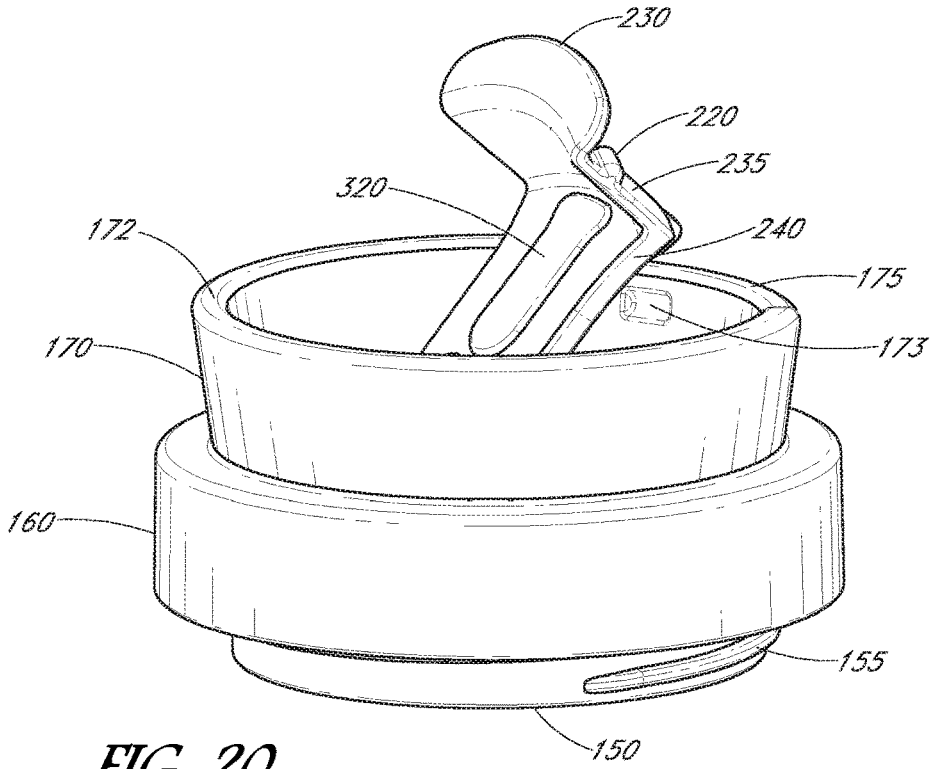
FIG. 20 illustrates an isometric view of the lid assembly of FIG. 17, shown from another aspect in an open position.

FIGS. 17-20 show various stages of operating the lid assembly 90. In particular, FIG. 17 shows the flap 200 in a closed position, FIGS. 18 and 19 show the flap 200 in a partially open position, and FIG. 20 shows the flap 200 in a fully open position. In one example, the fully open position can be the position in which the male detents 247 on the flap 200 engage the female detents 101 on the top wall 105. In other examples, the fully open position can be a position other than when the male detents engage the female detents.

Referring initially to FIG. 17, the lid assembly 90 is shown with the flap 200 in a closed position with the tab 230 of the flap 200 resting against or hovering slightly above the recessed edge of the cutout 175. The tab 230 can be substantially flush with the edge 172 of the rim 170 when in the closed position. The edge 231 of the tab 230 can extend radially past or radially outwardly of the rim 170 to serve as a surface for a user to press or push against to dislocate the locking lugs 220 on the flexible portion 235 from the notches 173 in or on the inner surface 171 of the rim 170.

The gasket 300 in the flap 200 not only can form a seal with the drink opening 110 and the vent aperture 108, but can also apply a spring force against the flap to push the flap towards the open position. This spring force can help maintain the engagement between the locking lugs 220 and the notches 173 in the closed position by loading or constraining the parts and removing possible slacks, making the disengagement between the locking lugs and the notches more difficult than when no loading is utilized. The force imparted by the user to deflect the extension 227 by pushing on the tab 230 of the flap 200 can also assist to swing the flap to the open position once the locking lugs 220 disengage from the notches 173.

As shown, the threads 155 extend around the outside of the sidewall 150 so that the lid assembly 10 can be threaded against the container 70. The external threads 155 are configured for threaded engagement with internal threads on the container 70. In other examples, the sidewall 150 can be provided with internal threads for engaging external threads on the container. A seal can be formed at the threaded connection between the lid assembly 90 and the container 70. The seam between the opening of the container 70 and the lid assembly 90 can be hidden by the cover 160 extending over the seam, which can optionally be provided with an O-ring or a gasket to improve sealing at the interface.

When a user decides to open the flap 200 to, for example, access the contents stored inside the container 70, the user can press the edge 231 of the tab 230 or the tab itself until the locking lugs 220 disengage from the notches 173, as shown in FIG. 18. When the locking lugs 220 are moved away from the notches 173, the spring force from the gasket 300 pressing against the top wall 105 and the force generated by the user on the tab 230 are released to move the locking lugs 220 away from the notches 173 and for the flap to rotate about the pivot holes and/or the pivot elements 250. The spring force from the gasket 300 can be controlled by determining the material and dimensions of the gasket 300, to control the amount on compression on the gasket between the body of the flap and the top wall of the housing. With the flap 200 now partially opened, the user can rotate the flap 200 towards the fully open position, as shown in FIG. 19.

From the position of FIG. 19, the flap 200 can further be rotated and held in a fully open position by rotating the flap 200 until the male detents 247 on each free end 246 of each leg 245 engages the female detent 102 in the first recessed section 102 of the depression 106. Once engaged, the flap 200 can be held in the fully open position by the detents until the user closes the flap 200 to seal the contents inside the container 70, which involves separating the mail detents 247 from the female detents 101.

With reference to FIG. 20, from the fully open position, the user can close the flap 200 by rotating the flap 200 towards the top wall 105 or towards the drink opening 110. As the flap 200 closes over the drink opening 110, the radial outward projections of the locking lugs 220 can contact the cutout 175 or the edge 172 of the rim 170. At this moment, additional force can be applied to the flap 200 towards the closed position to force the flexible portion 235 to deflect until the locking lugs 220 past the recessed edge of the cut out and slide against the inner surface 171 of the rim 170 to engage the notches 173. During this process, the gasket 300 is compressed to seal the vent aperture 108 and the drink opening 110. The drink opening seal 335 of the gasket can project into the drink opening 110 to seal against the perimeter of the drink opening or can form a face seal with an upper edge of the drink opening.

If the user applies additional forces against the flap 200, such as at the base portion 240 or the tab 230, the applied force can cause the flexible portion 235 to bend to allow the locking lugs 220 to slide against the inner surface 171 of the rim 170 and into the notches 173. The engagement between the locking lugs 220 and the notches 170 can secure the flap 200 in the closed position, at which time the gasket 300 may be compressed. The securement between the flap 200 and the rim 170 is reversible as the flap can swing back to the fully open position.

In another example, the additional closing force can be applied to the engaging surface 231 of the tab 230 to physically deflect the flexible portion 235 and move the flap 200 towards the closed position. The additional force can be released once the locking lugs 220 engage the notches 173 to secure the flap 200 in the closed position. In still other examples, when a closing force is applied to the tab 230, the base portion 240, such as the base elements 229, or both the base portion and the flexible portion 235, can flex to allow the locking lugs 220 to move past the edge of the rim into engagement with the notches 173.

Methods of making and of using the lid assembly and the drinking bottle shown and described elsewhere herein are within the scope of the present disclosure.

Although limited embodiments of the lid assembly, the drinking bottle, and their components have been specifically described and illustrated herein, many modifications and variations will be apparent to those skilled in the art. Furthermore, it is understood and contemplated that features specifically discussed for the lid assembly and drinking bottle embodiments may be adopted for inclusion with other lid assembly and drinking bottle embodiments, provided the functions are compatible. Accordingly, it is to be understood that the lid assembly, the drinking bottle, and their components constructed according to principles of the disclosed device, system, and method may be embodied other than as specifically described herein. The disclosure is also defined in the following claims.

What is claimed is:

1. A drinking container assembly comprising:

a lid assembly comprising a lid housing having (1) a top wall, (2) a circumferential rim extending above, elevation-wise, and surrounding the top wall and comprising an outer rim surface, an inner rim surface, relative to a central section of the lid assembly, at least one notch located on the inner rim surface, and an upper rim edge, and (3) a sidewall extending below, elevation-wise, the top wall and comprising an outer sidewall surface, an inner sidewall surface, relative to the central section of the lid assembly, and a lower sidewall edge;

a drink opening formed through the top wall and a vent opening formed through the top wall;

a flap rotatably coupled to the top wall and rotatable about a rotating axis, said flap comprising a body having a base portion having an opening, an extension having at least one locking lug projecting from an outer surface of the extension and engaging the at least one notch on the inner rim surface of the rim in a flap closed position to close the drink opening at the top wall, and a tab extending from an end of the extension, wherein the flap being rotatable from the flap closed position to a flap open position to expose the drink opening;

a gasket secured to a perimeter of the opening of the base portion of the flap and having an upper surface and a lower surface, the lower surface sealing both the drink opening and the vent opening in the flap closed position, the gasket being compressed between the top wall and the body of the flap in the closed position and the gasket is configured to impart a spring force on the flap in response to the at least one locking lug disengaging from the at least one notch when the flap is rotated from the flap closed position to the flap open position;

wherein said rim and said top wall define an upper chamber portion and said sidewall and said top wall define a lower chamber portion; and wherein the top wall has a first region located to one side of the rotating axis along a plane and a second region located to another side of the rotating axis along the plane; and wherein the drink opening and the vent opening are both located at the first region of the top wall so that both the drink opening and the vent opening are opened when the flap is in the flap open position or both the drink opening and the vent opening are closed when the flap is in the flap closed position.

2. The drinking container assembly of claim 1, wherein the tab at the end of the extension is movable to disengage the at least one locking lug from the at least one notch.

3. The drinking container assembly of claim 2, wherein the tab extends radially beyond the outer rim surface in the flap closed position.

4. The drinking container assembly of claim 3, wherein the extension comprises a second locking lug spaced from the at least one lug.

5. The drinking container assembly of claim 2, wherein the extension is deflected a distance greater than a height of the at least one locking lug.

6. The drinking container assembly of claim 5, wherein the at least one locking lug is a pair of spaced apart locking lugs and located on the outer surface of the extension.

7. The drinking container assembly of claim 2, wherein the gasket is made of a rubber material, an elastomeric material, or a thermoplastic elastomer and the lid is made from a polymer material.

8. The drinking container assembly of claim 2, wherein the gasket comprises a drink opening seal extending into the drink opening to form a seal at a perimeter of the drink opening.

9. The drinking container assembly of claim 8, wherein the lower surface of the gasket is a planar surface that seals the drink opening in the flap closed position.

10. The drinking container assembly of claim 2, wherein the upper rim edge defines a plane and the top wall defines a plane and wherein the two planes converge.

11. The drinking container assembly of claim 2, wherein the rim comprises a cutout and the tab is located at the cutout of the rim in the flap closed position.

12. The drinking container assembly of claim 1, wherein a first detent extends from the base portion of the flap and engages a second detent located on the top wall of the lid housing to retain the flap in the flap open position.

13. The drinking container assembly of claim 1, wherein the base portion has a pair of legs and the flap is pivotable about the top wall by a pivot element extending into the top wall from each leg.

14. The drinking container assembly of claim 13, wherein the pivot elements extend into a pair of pivot holes formed with the top wall.

15. The drinking container assembly of claim 1, wherein the drink opening formed through the top wall is located near an intersection between the top wall and the rim.

16. The drinking container assembly of claim 15, wherein the lid assembly is threaded to an open end of a container.

17. The drinking container of claim 1, wherein the top wall has a recessed section having a contour that is sized to receive at least the base portion of the flap.

18. A drinking container assembly comprising:

a lid assembly comprising a lid housing having (1) a circumferential rim comprising an outer rim surface, an inner rim surface, relative to a central section of the lid assembly, and an upper rim edge, (2) a top wall surrounded by the circumferential rim, and (3) a lower sidewall extending below, elevation-wise, the circumferential rim and comprising an outer sidewall surface, an inner sidewall surface, relative to the central section of the lid assembly, and a lower sidewall edge;

a drink opening formed through the top wall and a vent opening formed through the top wall, wherein the vent opening has a smaller opening size than the drink opening;

a flap rotatably coupled to the top wall and rotatable about a rotating axis, the flap comprising a body having a base portion having a first side and an opposed second side, an extension extending at an angle to the base portion, at least one locking lug projecting from an outer surface of the extension and engaging at least one notch on the inner rim surface of the rim in a flap closed position to close both the drink opening and the vent opening at the top wall, and a tab extending at an angle from the extension, the flap being rotatable from a flap closed position to close the drink opening with a gasket extending from the first side of the flap to a flap open position to expose the drink opening;

wherein the gasket has an upper surface and an opposed lower surface for closing the drink opening in the flap closed position; and wherein the top wall has a first region located to one side of the rotating axis along a plane and a second region located to another side of the rotating axis along the plane; and wherein the drink opening and the vent opening are both located at the first region of the top wall so that both the drink opening and the vent opening are opened when the flap is in the flap open position or both the drink opening and the vent opening are closed when the flap is in the flap closed position.

19. The drinking container assembly of claim 18, wherein the gasket is attached to a perimeter of an opening located at the base portion of the flap.

20. The drinking container assembly of claim 18, wherein the drink opening formed through the top wall is located near an intersection between the top wall and the rim.

21. The drinking container assembly of claim 20, wherein the lid assembly is threaded to an opening of a container.

22. The drinking container assembly of claim 20, wherein the gasket seals both the drink opening and the vent opening when the flap is in the flap closed position.

23. The drinking container of claim 18, wherein the top wall has a recessed section having a contour that is sized to receive at least the base portion of the flap.

24. A drinking container assembly comprising:

a lid assembly comprising a lid housing having (1) a circumferential rim comprising an outer rim surface, an inner rim surface, relative to a central section of the lid assembly, and an upper rim edge, (2) a top wall surrounded by the circumferential rim, and (3) a lower sidewall extending below, elevation-wise, the circumferential rim and comprising an outer sidewall surface, an inner sidewall surface, relative to the central section of the lid assembly, and a lower sidewall edge;

a drink opening formed through the top wall and a vent opening formed through the top wall, wherein the vent opening has a smaller opening size than the drink opening;

a flap rotatably coupled to the top wall, the flap comprising a body having a base portion having a first side with a gasket projecting outwardly from the first side and an opposed second side, an extension extending at an angle to the base portion, at least one locking lug on an outer surface of the extension engaging at least one notch on the inner rim surface of the rim in the flap closed position, and a tab extending at an angle from the extension, the flap engaged to engagement surfaces at the top wall and rotatable about a rotating axis to move between a flap closed position and a flap open position;

wherein the top wall has a first region located to one side of the rotating axis along a plane and a second region located to another side of the rotating axis along the plane; and wherein the drink opening and the vent opening are both located at the first region of the top wall so that both the drink opening and the vent opening are opened when the flap is in the flap open position or both the drink opening and the vent opening are closed when the flap is in the flap closed position; and wherein the gasket is compressed against a perimeter of the drink opening when the flap is in the flap closed position.

25. The drinking container assembly of claim 24, wherein the drink opening formed through the top wall is located near an intersection between the top wall and the rim.

26. The drinking container assembly of claim 25, wherein the lid assembly is threaded to an opening of a container.

27. The drinking container assembly of claim 26, wherein the gasket is attached to a perimeter of an opening of the base portion of the flap and is made from a material that is different from a material of the flap.

28. The drinking container assembly of claim 24, wherein the gasket seals both the drink opening and the vent opening when the flap is in the flap closed position.

29. The drinking container of claim 24, wherein the top wall has a recessed section having a contour that is sized to receive at least the base portion of the flap.

* * * * *